United States Patent [19]

Ohmura et al.

[11] Patent Number: 5,045,404

[45] Date of Patent: Sep. 3, 1991

[54] HEAT-RESISTANT STAINLESS STEEL FOIL FOR CATALYST-CARRIER OF COMBUSTION EXHAUST GAS PURIFIERS

[75] Inventors: Keiichi Ohmura; Miko Yamanaka, both of Sagamihara; Fumio Fudanoki, Hikari; Masayuki Tendoh, Sagamihara; Kenji Hirashima, c/o Nippon Steel Corporation Hikari Works, 3434, Oaza Shimada, Hikari; Masaaki Kobayashi, Kitakyushu; Shinji Shibata, Toyota; Tomoyuki Sugino, Toyota; Toshihiro Takada, Toyota; Yoshio Nishizawa; Akihiko Kasahara, both of Tokyo, all of Japan

[73] Assignees: Nippon Steel Corporation, Tokyo; Toyota Jidosha Kabushiki Kaisha, Toyota; Nippon Kinzoku Co., Ltd., Tokyo, all of Japan

[21] Appl. No.: 588,434

[22] Filed: Sep. 26, 1990

[30] Foreign Application Priority Data

Mar. 27, 1989 [JP] Japan ..... 1-71960
Nov. 28, 1989 [JP] Japan ..... 1-306412

[51] Int. Cl.[5] ..... C22C 38/18

[52] U.S. Cl. ..... 428/606; 420/40; 420/62; 148/325

[58] Field of Search ..... 420/40, 62; 148/325; 428/606

[56] References Cited

FOREIGN PATENT DOCUMENTS 0629243 9/1978 U.S.S.R. ..... 420/40
0929734 5/1982 U.S.S.R. ..... 420/40

*Primary Examiner*—Deborah Yee
*Attorney, Agent, or Firm*—Kenyon & Kenyon

[57] ABSTRACT

A heat-resistant stainless steel foil for a catalyst-carrier of combustion exhaust gas purifiers, consisting essentially in weight percentage of:

more than 0.06 up to 0.15 of Ln, the Ln being a mixture of La, Ce, Pr and Nd;
from 8x(%Ln+0.015) /45 to 0.1 of P;
from 4.5 to 6.5 of Al;
from 13 to 25 of Cr;
not more than 0.025 of C;
not more than 0.02 of N;
not more than 0.03 of C+N; and
the balance consisting of Fe and unavoidable impurities.

7 Claims, 3 Drawing Sheets

HEAT-RESISTANT STAINLESS STEEL FOIL FOR CATALYST-CARRIER OF COMBUSTION EXHAUST GAS PURIFIERS

BACKGROUND OF THE INVENTION

1. Field of the Invention

The present invention relates to a stainless steel foil having a high oxidation resistance and good processability and applicable to catalyst-carriers of combustion exhaust gas purifiers.

2. Description of the Related Art

The catalyst-carriers of combustion exhaust gas purifiers of automobiles, etc., are conventionally fabricated of a ceramics honeycomb. An advantageous alternative to the ceramics honeycomb is a heat-resistant stainless steel foil, by which the honeycomb wall thickness as well as the gas flow resistance and the heat capacity can be reduced, to thereby improve the engine performance and save the expensive catalyst metals. For example, Japanese Unexamined Patent Publication (Kokai) Nos. 50-92286, 50-144689 and 57-71898 proposed an Fe-Cr-Al-based heat-resistant metal foil for such a honeycomb structure.

Such an alloy must have specific characteristics, particularly the oxidation resistance and the adhesion of an oxide film thereof, and accordingly, the conventional metal foils are made of an alloy based on an Fe-Cr-Al alloy, and modified to provide an improved oxidation resistance and/or an improved adhesion with a wash coat, i.e, a direct support for catalysts, utilizing the established excellent properties of the Fe-Cr-Al alloy, such as the oxidation resistance and the adhesion of an oxide film, as an electrical heating element and a material to be used for the high temperature members of heating systems Nevertheless, the above-referred Japanese patent publications both use yttrium (Y) to improve the oxidation resistance, and the use of such an expensive element is acceptable only for very limited applications.

Japanese Unexamined Patent Publication (Kokai) No. 63-45351 proposed another modified Fe-Cr-Al-based alloy containing rare earth metals in a total amount of up to 0.06 wt %, including 0.002 to 0.05 wt % of rare earth metals from the group of La, Ce, Pr, and Nd, to prevent the spalling of an oxide film, and further proposed modified alloys supplemented with Zr or Nb in a content specified with respect to the C and N contents, to stabilize carbon and nitrogen in the alloy as a carbide and a nitride or to ensure the high temperature creep strength of the former alloy, respectively. This Japanese patent publication states that a total amount of rare earth metals of more than 0.06 wt % does not substantially improve the oxidation resistance, in comparison with a lower total amount, and further the working of the alloy becomes impossible at the usual hot-working temperatures.

Japanese Unexamined Patent Publication (Kokai) No. 63-45351 also states that the addition of Y to Fe-Cr-Al-based alloys is unacceptably expensive, and proposed that lanthanoid elements (hereinafter simply referred to as "Ln" or "the Ln elements") other than Ce or La alone be added to an alloy in an amount of from 0.05 to 0.20 wt %. This publication states that such a specified composition is based on the phenomenon that the reduction of the hot workability due to the Ln addition is caused by the presence of Ce, which also lowers the oxidation resistance, and therefore, the addition of Ln other than Ce enables an alloy to be hot-worked and improves the oxidation resistance. Nevertheless, the Ln elements are very reactive and have similar chemical properties, and therefore, are difficult to separate from each other and purify, and thus La is in fact much more expensive than mischmetal, which is a generally available mixture of the Ln elements, although La is inexpensive when compared with Y in an essentially pure form. Similarly, the separation and removal of Ce would also unavoidably raise the material price.

Moreover, although the above-mentioned conventional technologies made a study of the adhesion of an oxide film and the oxidation resistance, these publications do not take into consideration the influence of the chemical composition of a component foil of a honeycomb on the structural durability of a catalyst-carrier when used in a high temperature exhaust gas flow.

SUMMARY OF THE INVENTION

The object of the present invention is to provide a heat-resistant stainless steel foil having an improved oxidation resistance and adhesion of an oxide film even when exposed to a hot combustion exhaust gas, which will effectively enhance the structural durability of a catalyst-carrier, and furthermore has a good processability, including a hot-workability, and is available at a low price.

To achieve the above object according to the present invention, there is provided a heat-resistant stainless steel foil for a catalyst-carrier of combustion exhaust gas purifiers, consisting essentially in weight percentage of:

more than 0.06 up to 0.15 of Ln, the Ln being a mixture of La, Ce, Pr and Nd;

from 8x(% Ln+0.015)/45 to 0.1 of P;

from 4.5 to 6.5 of Al;

from 13 to 25 of Cr;

not more than 0.025 of C;

not more than 0.02 of N;

not more than 0.03 of C+N; and the balance consisting of Fe and unavoidable impurities.

In accordance with need, the present inventive steel foil may further contain (0.03+4x%C+24x%N/7) or less of Ti and/or (93x%C/12+93x%N/14)x1.5 or less of Nb, whereby the toughness of a hot strip is remarkably improved.

The present inventors found that an Ln content of more than 0.06 wt % remarkably improves the oxidation resistance of an Fe-Cr-Al-based alloy foil in an exhaust gas and that, in this case, hot-working can be carried out under the hot-working condition for usual stainless steels, and a separation of the Ln elements such as proposed by J.U.P.P. No. 63-45351 is not required, provided that the P content is within the specified range as later described in accordance with the Ln content. Stress is generated between an oxide film and a substrate metal, as the oxide film grows, and this stress causes a deformation of the substrate metal, and in particular, a large deformation occurs when the substrate metal has a thickness of less than 100 μm. The present inventors found that an Ln content of more than 0.06 wt % also mitigates such a deformation of the metal foil.

A poor toughness of hot-rolled strip renders the mass-production difficult, because brittle cracks easily occur during handling or cold-rolling after hot-rolling.

From this point of view, the present inventors studied the processability of such an Fe-Cr-Al-based stainless steel and found that an addition of Ti and/or Nb to the steel remarkably improves the toughness of hot strips, which is vital to the factory mass-production of usual stainless steel sheets from hot coils.

The reasons for the limiting of the specified contents according to the present invention will be described below. Note, the chemical composition is expressed in weight percentage throughout the present specification.

(1) Ln

Ln, or lanthanoids, is a general term expressing fifteen elements from La to Lu in the periodic table. In the present invention, a "mischmetal" may be used as an inexpensive source material providing Ln elements in the steel. The elements actually detected when analyzing a foil are La, Ce, Pr, and Nd; other elements, if any, are present in an amount so minute that they can be ignored. Accordingly, the Ln of the present invention means a mixture of these four elements La, Ce, Pr, and Nd, and a mischmetal is used as the Ln source.

As aforementioned, Ln improves the resistance of a foil against an abnormal oxidation by an exhaust gas. FIG. 3 shows that the endurance time to the beginning of an abnormal oxidation (or the life to breakaway of foil) is significantly increased when the Ln content is greater than 0.06%, and is again reduced when the Ln content is greater than 0.15%. The foil of the present invention usually has a thickness so small that the stress generated at the oxide film/substrate metal interface due to the growth of the oxide film causes an elongation or deformation of the foil. The present inventors found that the extent of this deformation depends of the Ln content, and is reduced when the Ln content is increased to an amount of more than 0.06 wt %. This effectively reduces the shape change of a catalyst-carrier made of the foil when used at high temperatures, and thus improves the structural durability of a catalyst carrier, as later shown in examples.

Therefore, Ln is an indispensable component in the present inventive steel, to ensure the provision of the total effect as represented by the above-described two effects, and must be contained in an amount of more than 0.06% up to 0.15%.

(2) P

P or phosphorus is important to an improvement of the hot-workability, when interrelated with Ln.

The present invention uses Ln in an amount within the above-specified range, to improve not only the oxidation resistance of a foil but also the durability of a catalyst carrier composed of the foil. It is conventionally believed that such a great amount of Ln lowers the hot-workability and makes it difficult to produce a foil by a process for the mass-production of usual stainless steel sheets, and that this is because Ce, which is a major component of a mischmetal, tends to react with Fe to form an intermetallic compound having a low melting point. The present inventors, however, found that the hot-workability is not lowered at all by a large amount of Ln, when used together with P, because a portion of Ce and La form a high melting point phosphide in the form of relatively fine particles as small as, for example, 3 μm or less. To obtain this effect, the P content must be $8x(Ln\% - 0.009)/45$ in wt % or more when Ln is present in the specified amount of more than 0.06 wt % and up to 0.15 wt %, as seen from FIG. 1. Nevertheless, this is based on a result obtained from a laboratory experiment using a very small ingot, and the influence of a compositional segregation on the factory manufacture thereof must be also taken into consideration, as a large ingot is used in such a process. Therefore, studies were carried out from this point of view and the P content according to the result obtained from the studies was determined as $8x(Ln\% + 0.015)/45$ in wt %.

P, however, lowers the toughness of ferritic stainless steels, and thus the P content must be limited, particularly when added to an Fe-Cr-Al-based stainless steel which essentially has a poor toughness. Accordingly, in the present invention, the P content must not be more than 0.1 wt %. Note, a P addition at an amount within this range does not adversely affect the oxidation resistance of the foil.

(3) Al

The addition of Al or aluminum is essential to ensure the oxidation resistance of the present inventive steel. When the Al content is less than 4.5 wt %, the protection against oxidation in an exhaust gas is very poor and an abnormal oxidation of a foil easily occurs to an extent such that the foil cannot be used as a catalyst-carrier. On the other hand, when the Al content is more than 6.5 wt %, not only the toughness of a hot-rolled strip is greatly lowered to thereby impair the processability but also the thermal expansion coefficient becomes extremely high and leads to a serious amount of thermal fatigue due to the repeated heating and cooling effects when used as a catalyst carrier. Therefore, according to the present invention, the Al content must be from 4.5 to 6.5 wt %.

(4) Cr

Cr or chromium must be included to ensure the corrosion resistance of stainless steels. The heat resisting property of the present inventive steel is substantially ensured by an $Al_2O_3$ film, and the adhesion of and the protection afforded by the $Al_2O_3$ film become poor when the Cr amount is too low. On the other hand, when an excessive amount of Cr is contained, the toughness of a hot-rolled strip is lowered. Accordingly, the sufficient, but not excessive, Cr content according to the present invention is 13 to 25 wt %.

(5) C and N

Both carbon and nitrogen causes an extreme lowering the toughness of a hot-rolled strip according to the present invention, and although this harmful effect can be suppressed by Ti or Nb, as will be later described in detail, the recovery of the toughness becomes difficult when the C content is more than 0.025 wt %, when the N content is more than 0.02 wt %, or when the C+N content or the total amount of C and N is 0.03 wt %. Accordingly, the C content must be not more than 0.025 wt %, the N content must be not more than 0.02 wt %, and the C+N content must be not more than 0.03 wt %.

(6) Ti

Ti is optionally used as an additive element to improve the toughness of hot-rolled strip of the present inventive steel, and the Ti content is determined in relation to the C and the N contents. When the Ti content is too high, coarse rectangular TiN particles are precipitated in crystal grains and tends to generate cracks at the particles, to thereby lower the toughness. Accordingly, the Ti content is limited to not more than $(0.03 + 4x\%C + 24x\%N/7)$ in wt %. This Ti addition, even at such a minute amount, significantly improves the toughness.

The toughness-improving effect of Ti is originally due to the stabilizing of C and N, and therefore, when Ti is added to the present inventive steel for this purpose, the addition is preferably effected at a Ti content of at least 0.02 wt %.

It is also observed that the Ti addition, even at such a minute amount, suppresses the elongation of a foil due to the growth of an oxide film.

(7) Nb

Nb is also optionally used as an additive element, to improve the toughness of hot-rolled strip of the present inventive steel, as described for Ti, and the Nb content is also limited in relation to the C and the N contents. To ensure a significant toughness-improving effect, Nb is preferably added at an amount of not less than (93x%C/12+93x%N/14)x0.8 in wt %. On the other hand, the Nb content must be limited to not more than (93x%C12+93x%N/14)x1.5 in wt %, because when it exceeds this limit, a problem arises in that cracks in an as-cast ingot tends to appear during the cooling thereof before the toughness-improvement effect reaches saturation.

Ti and Nb may be used either separately or in combination, to improve the toughness of hot-rolled strip without an adverse effect on the oxidation resistance of a catalyst-carrier.

(8) Impurities

Mn is preferably limited to not more than 0.3 wt %, because Mn is concentrated in an oxide film formed during the initial oxidation, to thereby adversely affect the subsequent formation of an $Al_2O_3$ film and yield a defective film structure.

Si improves the oxidation resistance but significantly lowers the toughness of a hot-rolled strip. The high-Al ferritic stainless steel of the present invention essentially has a superior oxidation resistance, and thus the Si content is preferably as small as possible or not more than 0.5 wt %.

Similar to P, S tends to react with Ln to form a high melting point compound, but also lowers the oxidation resistance. Therefore, the S content is preferably limited to not more than 0.003 wt % in the present invention.

Mg improves the adhesion of oxide film and the oxidation resistance of the high-Al stainless steel of the present invention, but the Mg addition is not necessarily required for this purpose in the present invention. Although Mg is unavoidably entrained in the high-Al stainless steel during the steelmaking process, the amount of entrained Mg is around 200 ppm at most, which does not adversely affect the hot-workability and the oxidation resistance at all.

The present inventive Fe-Cr-Al-based alloy having the above-described composition is produced in the form of a foil as thin as around 50 μm, by the melting, hot-rolling and cold-rolling processes such as used for the large scale manufacture or mass-production of usual stainless steels, an annealing being carried out in accordance with need. The thus-produced foil, a catalyst-carrier composed of the foil for purifying exhaust emissions, and a catalyst apparatus, not only have an excellent resistance to an abnormal oxidation even under a high temperature combustion exhaust gas atmosphere but also effectively improve the structural durability of such catalyst-carriers and apparatuses.

DESCRIPTION OF THE PREFERRED EMBODIMENTS

EXAMPLE 1

The hot-workability was studied in relation to the Ln and P contents of Fe-20Cr-5Al steels having the chemical compositions as shown in Table 1, in which the S content is 0.003 wt % or less and the oxygen content was 0.003 wt % or less for all of the steels used.

Figure 1:
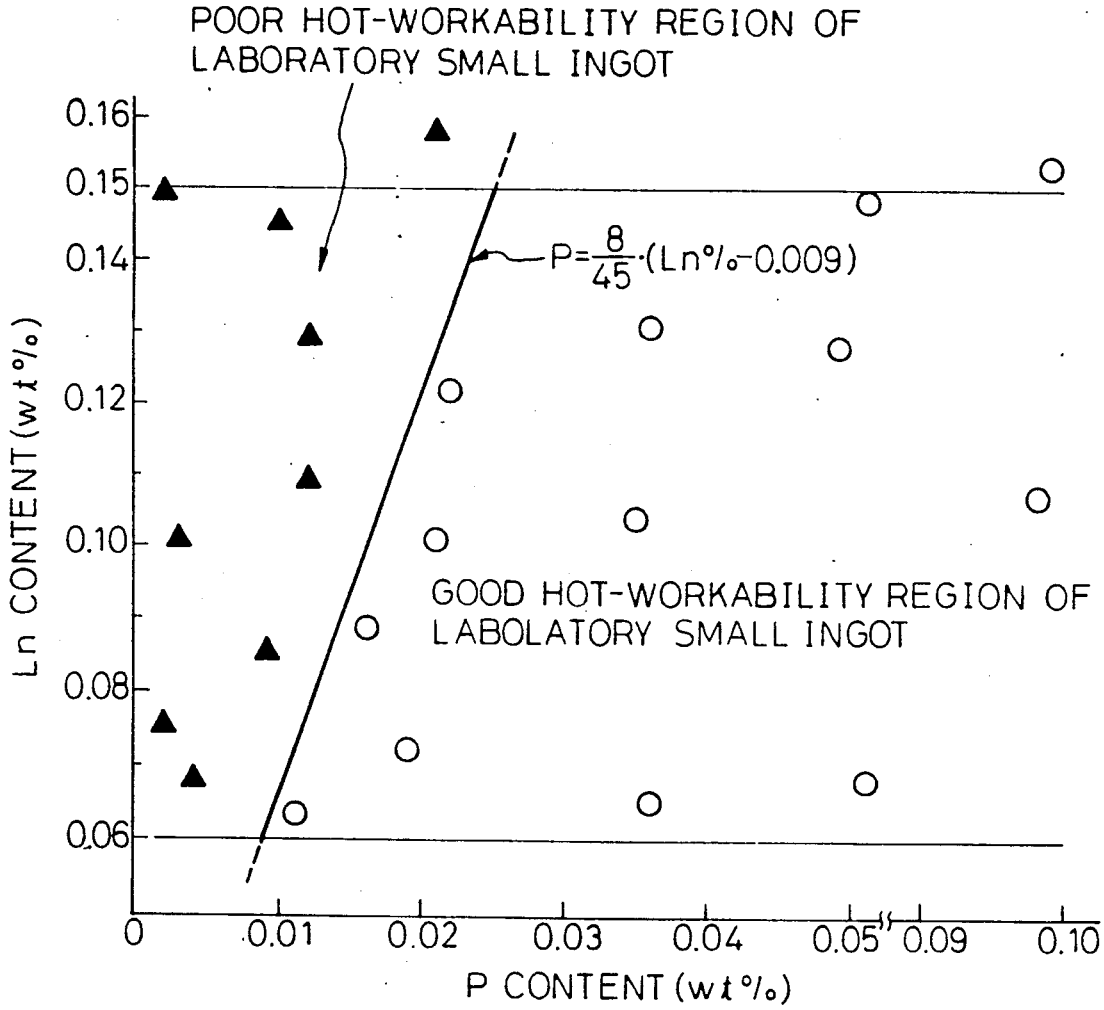
FIGS. 1 and 2 show the hot-workability of Fe-Cr-Al-based stainless steels as a function of the Ln and P contents of steel.

Steels P1 to P22 were melted in a vacuum arc melting furnace in an amount of 100 g of each steel and were cast into an about 12 mm thick, 22 mm wide, 74 mm long ingot, which was heated at 1200° C. for 3 hr and then cooled to room temperature, and thereafter, reheated at 1150° C. for 0.5 hr followed by hot-rolling with a single pass at a reduction of 50%. During the hot-rolling, severe cracking occurred in steels P1, P2, P7, P9, P10, P14, P18, P19, and P20 but no cracking was observed for the other steels, as summarized in Table 1. FIG. 1 shows the interrelationship between the occurrence of cracking and the Ln and P content. This laboratory scale experiment using a small melt leads to the conclusion that, to ensure a good hot-workability, the P content must be 8x(%Ln−0.009)45 wt % or more when the Ln content is from more than 0.06 and up to 0.15 wt %.

Figure 2:
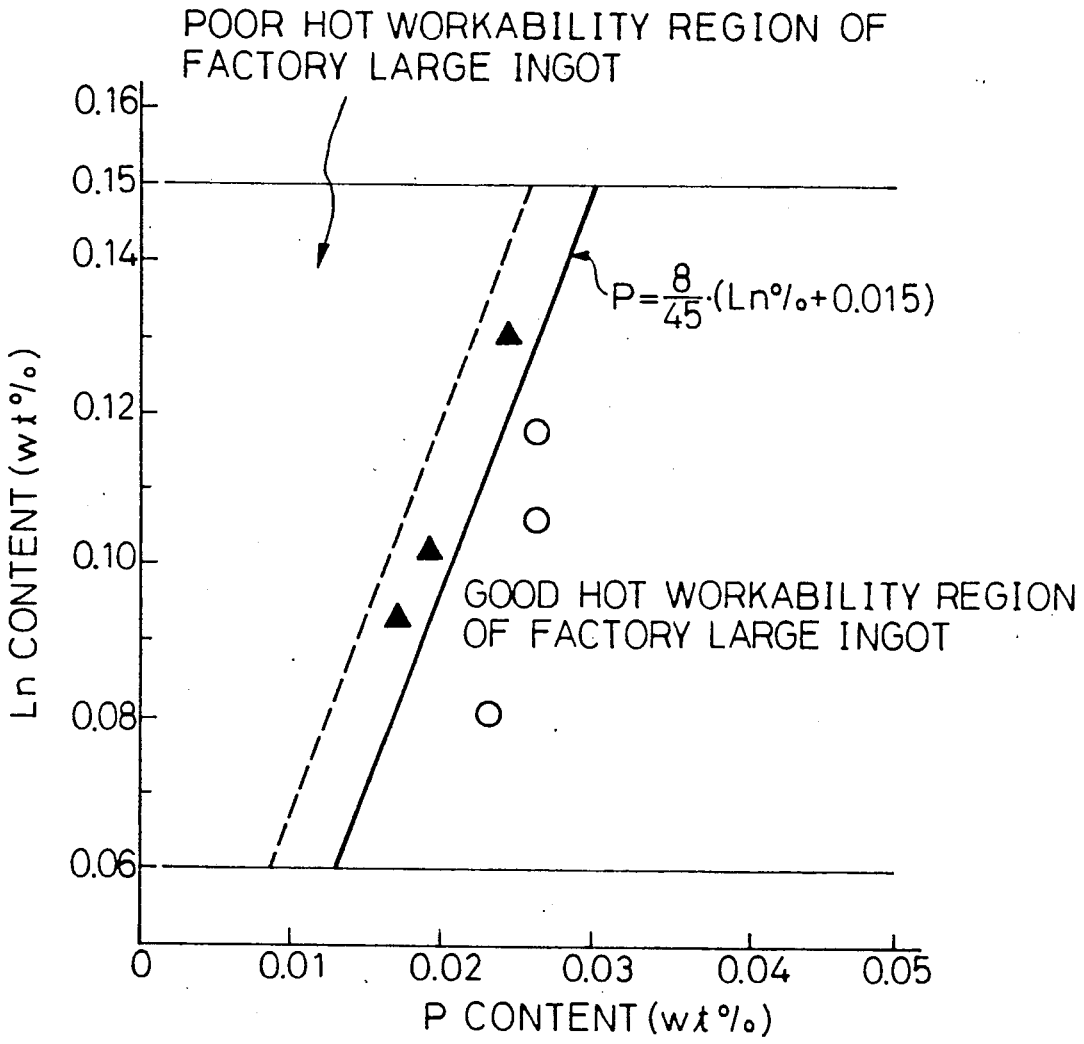

Then an extensive study was carried out by using a large factory size ingot having the chemical compositions as shown in Table 1, as steels P23 to P28. The values are obtained by analyzing samples from the molten steels just before casting. These steels were melted in a vacuum induction furnace and cast into a 300-kg ingot for steels P23 to P26 or continuous-cast into an 8-ton square section slab for steels P27 and P28, respectively. Fortyfive square samples having a thickness of 20 mm, a width of 30 mm, and a length of 50 mm for testing the hot-workability were cut from each of the large ingots, at positions corresponding to the top length, the $\frac{1}{4}$ length, the middle length, and the $\frac{3}{4}$ length sites along the ingot length direction, the near surface, the $\frac{1}{4}$ thickness, and the middle thickness sites along the thickness direction, and the near side, the $\frac{1}{4}$ width, and the middle width sites along the width direction. A hot-workability test of these samples was carried out in the same manner as for the small laboratory ingot, and the results are summarized in FIG. 2, which shows that cracking did not occur at all in samples from steels P24, P26 and P28, whereas cracking occurred in some samples from steels P23, P25 and P27.

This leads to the conclusion that, to ensure a good hot-workability in the factory manufacture process, the P content must be 8x(%Ln+0.015)/45 wt % or more when the Ln content is from more than 0.06 and up to 0.15 wt %.

The difference between the P contents required for the small and the large ingots is considered to be mainly due to the segregation of Ln.

EXAMPLE 2

The processability of a hot-rolled strip, particularly the toughness thereof, was studied by using steels having the chemical compositions as shown in Table 2.

The steels were vacuum-melted and cast into a 25-kg ingot, which was heated at 1180° C. for 1 hr and immediately hot-rolled, to form a 4 mm thick strip, at a finishing temperature of 880° to 900° C., from which the hot-rolled strip was allowed to cool in the air until the temperature of the strip surface reached 300° C., placed in a heating furnace held at 250° C., held there for 1 hr, and then cooled in the furnace to room temperature.

In this sequence, severe cracking occurred during the hot-rolling of steels B1 and B2 of the comparative steels, which indicates that these two steels lack hot-workability. In other steels of both the series A and B, well shaped hot-rolled strips were obtained. The results are summarized in Table 3, in which the symbol "x" means that cracking occurred and the symbol "a" denotes that cracking did not occur.

⅓-subsize V-notch charpy impact test pieces were sampled from the hot-rolled strips, except for steels B1 and B2, the longitudinal direction of the test piece being parallel to the rolling direction of the strip, and were used for testing the toughness of the hot-rolled strip. The results are shown in the column "Toughness of hot-rolled strip" of Table 3.

The toughness was evaluated by the testing temperature at which the average value of the impact absorbed energy for three tests exceeded 5.5 kgm/cm$^2$, and was graded "aa" when the temperature was 60° C. or lower, "a" when higher than 60° C. and up to 90° C., "x" when higher than 90° C. and up to 120° C., and "xx" when higher than 120° C. The "aa" grade steel can be cold-rolled in the mass-production process without particular care, and the grade "a" steel is also essentially mass-productable, although a slight heating and heat reserving is required in some cases. Although it is not absolutely impossible to cold-roll the "x" grade steel in the factory mass-production line, the strip temperature must be precisely controlled, which unavoidably causes a great reduction of the productivity and a significant cost rise. The "xx" grade steel can not apply at all to the factory mass-production process for usual stainless steels by a hot-coil.

All of the series A steels of the present invention show a superior toughness of the hot-rolled strip and are relatively easily applied to the factory mass-production line. Particularly, the steels supplemented with Ti and/or Nb exhibit a very high toughness. In contrast, all of the comparative steels have a poor toughness and are judged to have problems in the processability thereof.

The hot-rolled strips were annealed, shot-blasted, and pickled, and were then cold-rolled to a thickness of 0.8 mm at room temperature for steels A1 and A7 through A11, at 70° C. for other steels of the series A, at 110° C. for steels B4 and B8 through B11, or at 160° C. or higher for steels B3 and B5 through B7. Edge cracks were observed in steels B6 and B7.

The cold-rolled strips were annealed, shot-blasted, pickled and trimmed, and then cold-rolled at room temperature to a foil. Breakage did not occur in any of the strips. In the strips of steels B6 and B7, edge cracks appeared and the rolling was interrupted when the rolled thickness was 65 μm. Other strips of both the series A and B were rolled to a thickness of 50 μm without problem. The results are summarized in Table 3 in the column "Cold-rollability", in which steels B6 and B7 are marked "x", indicating the occurrence of edge cracks, but the other steels are marked "a".

To summarize the above results, it was proved that the steels according to the present invention have a good processability, but that the comparative steels cause problems during the processing thereof to a foil, i.e., have a poor processability.

EXAMPLE 3

Studies were carried out of the durability time before a breakaway due to an abnormal oxidation of a foil in an engine exhaust emission, and the structural durability of catalyst carrier, by using steels having the chemical compositions as shown in Table 4.

The foils prepared in Example 2 were used for some of these steels and for the other steels, foils were prepared by the same process steps as used in Example 2, from melting to hot-rolling, except that the hot-rolled strips were allowed to be air-cooled to room temperature, and the hot-rolled strips were again processed in the same way as in Example 2, in which cold-rolling was carried out with the necessary heating of the strips, to obtain 50 μm thick foils. During the above-mentioned process for obtaining the final foil, neither edge cracks nor slivers occurred in the steel series A and B.

A test of these foils was carried out to evaluate the durability thereof against abnormal oxidation, in which the foil was placed in a heating furnace containing a gasoline engine exhaust gas and held there at 1170° C. for 20 hr, and this heating was repeated until an abnormal oxidation of foil occurred. All of the foils used for testing were 50±2 μm thick, and three foils were tested for each steel; in which the duration times until the abnormal oxidation occurred were averaged and the thus obtained value is used as an "abnormal oxidation life" for the steel. The occurrence of an abnormal oxidation was judged by visual observation.

The results are summarized in Table 4, from which it is seen that all of the foils according to the present invention have a long life of 250 hr or more, but the comparative foils have a short life of 200 hr or less.

Figure 3:
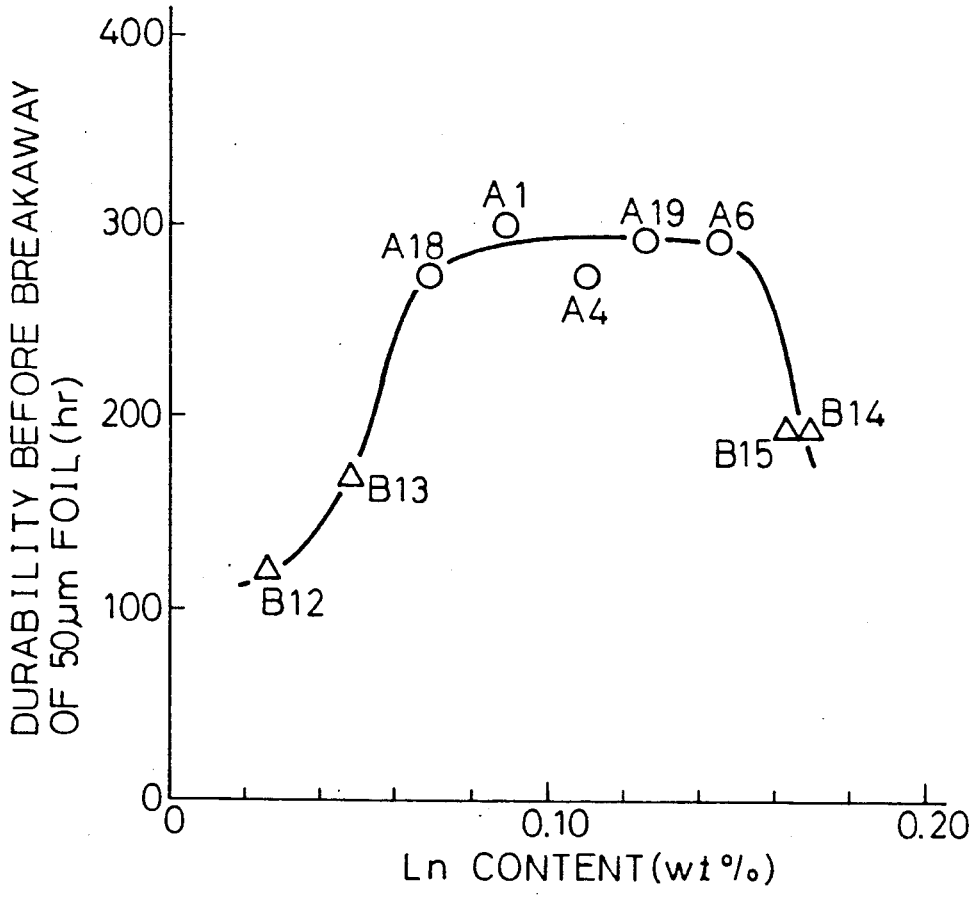
FIG. 3 shows a relationship between the lanthanoids content of the present inventive Fe-Cr-Al stainless steel foil and the durability time before a breakaway occurs due to an abnormal oxidation by an engine exhaust emission.

FIG. 3 shows the interrelationship between the abnormal oxidation life and the lanthanoids content of the present inventive steels A1, A4, A6, A18 and A19 and the comparative steels B12, B13, B14 and B15. It is apparent from FIG. 3 that the abnormal oxidation life is significantly prolonged when the Ln content is more than 0.06 wt % and the life is shortened again when the Ln content is more than 0.15 wt %.

10 mm wide and 50 mm long test pieces cut from the foils were subjected to oxidation by heating at 1100° C. in air for 100 hr, and the length change of the test pieces were then determined, as summarized in Table 4. The length change due to oxidation depends on the Ln content, in that the length change is significantly great in the comparative steels having the Ln content of 0.06 wt % or less or of more than 0.15 wt %, which lowers the structural durability of a catalyst-carrier.

To summarize the above-obtained results, the optimum range of the Ln content is more than 0.06 wt % and up to 0.15 wt %, on which basis the total Ln content according to the present invention is specified.

EXAMPLE 4

A study was carried out of the structural durability of a catalyst-carrier, in which foils of the present inventive steels A4, A9 and A10 and the comparative steels B12 and B14 as shown in Table 4 were used.

For each steel, a sheet of the aforementioned cold-rolled flat foil was shaped to a wavy foil having a wave period of 3.5 mm and a wave amplitude of 3.2 mm, which was then overlaid on and wound with a sheet of a non-shaped flat foil, to form a cylindrical honeycomb having an apparent outer diameter of about 40 mm and a length of 60 mm, and this structure was brazed in vacuum by using a commercially available Ni-base brazing powder, to produce a catalyst-carrier.

The thus-obtained catalyst-carrier of each steel was placed in a heating furnace containing an engine exhaust gas atmosphere, heated there at 1000° C. for 5 min, taken out of the furnace, and forcibly air-cooled to room temperature. After this heating-and-cooling cycle was repeated 900 times, the length change of the catalyst-carrier was measured and the external appearance of the catalyst-carrier was visually observed. The results are summarized in Table 5.

It is seen from Table 5 that catalyst-carriers of the series A steels according to the present invention have an elongation as small as 1.5% or less and a small change in external shape, but the catalyst-carriers of the comparative steels of the series B have a large elongation of 4% or more and a large change in external shape, an abnormal oxidation being also partially observed.

This shows that the present inventive foil also has an advantage of improving the structural durability of a catalyst-carrier.

As described above, the Fe-Cr-Al-based stainless steel foil according to the present invention has both a superior resistance to an abnormal oxidation in an engine exhaust gas and a superior processability, because of a good hot-workability and a high toughness of the hot-rolled strips, and further, has an advantage of improving the structural durability of catalyst-carriers, and thus is suitable as a foil composing a catalyst-carrier of combustion exhaust gas purifiers of automobiles, etc.

TABLE 1

(wt %) (Steels marked "o" are within the range of the invention)

| Steel | Lanthanoids total | La | Ce | Pr | Nd | P | Al | Cr | C | N | C + N | lower limit of P | Condition after hot-rolling |
|---|---|---|---|---|---|---|---|---|---|---|---|---|---|
| P1 | 0.075 | 0.025 | 0.034 | 0.007 | 0.009 | 0.002 | 5.0 | 19.7 | 0.004 | 0.0041 | 0.0081 | 0.016 | cracked |
| P2 | 0.068 | 0.022 | 0.031 | 0.008 | 0.007 | 0.004 | 5.0 | 19.7 | 0.003 | 0.0032 | 0.0062 | 0.015 | cracked |
| P3 | 0.063 | 0.018 | 0.030 | 0.007 | 0.008 | 0.011 | 5.2 | 19.8 | 0.004 | 0.0054 | 0.0094 | 0.014 | good |
| o P4 | 0.072 | 0.024 | 0.033 | 0.006 | 0.009 | 0.019 | 5.4 | 19.8 | 0.004 | 0.0052 | 0.0092 | 0.016 | good |
| o P5 | 0.065 | 0.021 | 0.031 | 0.005 | 0.008 | 0.036 | 4.9 | 20.3 | 0.004 | 0.0054 | 0.0094 | 0.015 | good |
| o P6 | 0.068 | 0.019 | 0.030 | 0.009 | 0.010 | 0.051 | 4.9 | 20.4 | 0.004 | 0.0056 | 0.0096 | 0.015 | good |
| P7 | 0.085 | 0.022 | 0.036 | 0.011 | 0.016 | 0.009 | 5.1 | 20.1 | 0.004 | 0.0051 | 0.0091 | 0.018 | cracked |
| P8 | 0.088 | 0.027 | 0.040 | 0.010 | 0.011 | 0.016 | 5.2 | 19.7 | 0.005 | 0.0047 | 0.0097 | 0.019 | good |
| P9 | 0.101 | 0.035 | 0.048 | 0.008 | 0.010 | 0.003 | 5.2 | 20.4 | 0.003 | 0.0045 | 0.0075 | 0.021 | cracked |
| P10 | 0.109 | 0.034 | 0.044 | 0.012 | 0.019 | 0.012 | 5.3 | 20.3 | 0.003 | 0.0045 | 0.0075 | 0.023 | cracked |
| o P11 | 0.102 | 0.031 | 0.040 | 0.011 | 0.020 | 0.021 | 5.3 | 20.2 | 0.003 | 0.0031 | 0.0061 | 0.021 | good |
| o P12 | 0.104 | 0.030 | 0.041 | 0.012 | 0.021 | 0.035 | 5.2 | 20.5 | 0.004 | 0.0041 | 0.0081 | 0.022 | good |
| o P13 | 0.107 | 0.029 | 0.038 | 0.018 | 0.022 | 0.098 | 5.1 | 20.4 | 0.004 | 0.0034 | 0.0074 | 0.022 | good |
| P14 | 0.129 | 0.037 | 0.046 | 0.018 | 0.027 | 0.012 | 5.2 | 19.9 | 0.004 | 0.0033 | 0.0073 | 0.026 | cracked |
| P15 | 0.122 | 0.041 | 0.053 | 0.011 | 0.017 | 0.022 | 5.2 | 20.1 | 0.004 | 0.0031 | 0.0071 | 0.025 | good |
| o P16 | 0.131 | 0.040 | 0.058 | 0.013 | 0.020 | 0.036 | 5.3 | 20.3 | 0.003 | 0.0042 | 0.0072 | 0.026 | good |
| o P17 | 0.128 | 0.031 | 0.049 | 0.023 | 0.025 | 0.049 | 4.9 | 20.4 | 0.005 | 0.0015 | 0.0065 | 0.026 | good |
| P18 | 0.149 | 0.042 | 0.062 | 0.021 | 0.024 | 0.002 | 5.0 | 20.4 | 0.005 | 0.0025 | 0.0075 | 0.030 | cracked |
| P19 | 0.145 | 0.041 | 0.064 | 0.019 | 0.021 | 0.010 | 5.1 | 20.3 | 0.005 | 0.0011 | 0.0061 | 0.029 | cracked |
| P20 | 0.158 | 0.046 | 0.063 | 0.024 | 0.025 | 0.021 | 5.1 | 20.3 | 0.005 | 0.0031 | 0.0081 | 0.031 | cracked |
| o P21 | 0.148 | 0.047 | 0.061 | 0.019 | 0.021 | 0.051 | 5.2 | 20.2 | 0.006 | 0.0044 | 0.0104 | 0.029 | good |
| P22 | 0.153 | 0.045 | 0.063 | 0.021 | 0.024 | 0.099 | 5.3 | 20.3 | 0.005 | 0.0041 | 0.0081 | 0.030 | good |
| P23 | 0.093 | 0.028 | 0.042 | 0.011 | 0.012 | 0.017 | 5.2 | 19.8 | 0.008 | 0.0035 | 0.0115 | 0.020 | cracked |
| o P24 | 0.081 | 0.022 | 0.038 | 0.011 | 0.010 | 0.023 | 5.1 | 20.2 | 0.009 | 0.0043 | 0.0133 | 0.018 | good |
| P25 | 0.131 | 0.038 | 0.057 | 0.014 | 0.022 | 0.024 | 5.1 | 20.3 | 0.006 | 0.0044 | 0.0104 | 0.026 | cracked |
| o P26 | 0.118 | 0.040 | 0.054 | 0.011 | 0.013 | 0.026 | 5.3 | 20.1 | 0.006 | 0.0056 | 0.0116 | 0.024 | good |
| P27 | 0.102 | 0.031 | 0.039 | 0.012 | 0.020 | 0.019 | 5.1 | 20.1 | 0.008 | 0.0035 | 0.0115 | 0.021 | cracked |
| o P28 | 0.106 | 0.029 | 0.038 | 0.018 | 0.021 | 0.026 | 4.9 | 20.7 | 0.006 | 0.0044 | 0.0104 | 0.022 | good |

TABLE 2

(wt %)

| Steel | | Lanthanoids total | La | Ce | Pr | Nd | P | Al | Cr | C | N | C + N | Others | lower limit of P | Upper limit of Ti and Nb |
|---|---|---|---|---|---|---|---|---|---|---|---|---|---|---|---|
| Present Invention | A1 | 0.087 | 0.031 | 0.043 | 0.004 | 0.009 | 0.024 | 5.3 | 19.3 | 0.007 | 0.0065 | 0.0135 | — | 0.019 | |
| | A2 | 0.089 | 0.034 | 0.041 | 0.006 | 0.008 | 0.037 | 5.1 | 20.3 | 0.007 | 0.0055 | 0.0125 | — | 0.019 | |
| | A3 | 0.095 | 0.032 | 0.040 | 0.010 | 0.013 | 0.042 | 5.2 | 20.1 | 0.006 | 0.0043 | 0.0103 | — | 0.020 | |
| | A4 | 0.108 | 0.033 | 0.051 | 0.011 | 0.013 | 0.026 | 5.1 | 20.8 | 0.008 | 0.0077 | 0.0157 | — | 0.022 | |
| | A5 | 0.109 | 0.031 | 0.045 | 0.016 | 0.017 | 0.036 | 5.1 | 19.7 | 0.010 | 0.0066 | 0.0166 | — | 0.023 | |
| | A6 | 0.143 | 0.041 | 0.062 | 0.020 | 0.023 | 0.041 | 5.4 | 20.7 | 0.011 | 0.0054 | 0.0164 | — | 0.028 | |
| | A7 | 0.075 | 0.028 | 0.036 | 0.003 | 0.008 | 0.026 | 5.6 | 19.2 | 0.006 | 0.0042 | 0.0102 | — | 0.016 | |
| | A8 | 0.085 | 0.031 | 0.037 | 0.006 | 0.011 | 0.021 | 6.3 | 16.3 | 0.011 | 0.0065 | 0.0175 | Nb: 0.17 | 0.018 | Nb: 0.19 |
| | A9 | 0.091 | 0.029 | 0.043 | 0.008 | 0.011 | 0.043 | 5.3 | 24.2 | 0.012 | 0.0096 | 0.0216 | Nb: 0.15 | 0.019 | Nb: 0.23 |
| | A10 | 0.073 | 0.025 | 0.039 | 0.003 | 0.006 | 0.028 | 5.2 | 19.1 | 0.009 | 0.0069 | 0.0159 | Ti: 0.063 | 0.016 | Ti: 0.089 |
| | A11 | 0.095 | 0.034 | 0.041 | 0.009 | 0.011 | 0.029 | 5.0 | 20.7 | 0.011 | 0.0077 | 0.0187 | Ti: 0.063 Nb: 0.14 | 0.020 | Ti: 0.100 Nb: 0.20 |
| Comparison | B1 | 0.094 | 0.020 | 0.058 | 0.007 | 0.009 | 0.013 | 5.2 | 20.2 | 0.008 | 0.0080 | 0.0160 | — | 0.020 | |
| | B2 | 0.147 | 0.042 | 0.062 | 0.018 | 0.023 | 0.019 | 5.2 | 20.4 | 0.008 | 0.0065 | 0.0145 | — | 0.029 | |
| | B3 | 0.064 | 0.026 | 0.032 | 0.003 | 0.003 | 0.019 | 5.3 | 16.2 | 0.029 | 0.0075 | 0.0365 | — | 0.015 | |

TABLE 2-continued (wt %)

| Steel | | Lanthanoids total | La | Ce | Pr | Nd | P | Al | Cr | C | N | C + N | Others | lower limit of P | Upper limit of Ti and Nb |
|---|---|---|---|---|---|---|---|---|---|---|---|---|---|---|---|
| | B4 | 0.078 | 0.027 | 0.038 | 0.006 | 0.007 | 0.019 | 5.1 | 19.2 | 0.019 | 0.0161 | 0.0351 | Nb: 0.28 | 0.017 | Nb: 0.38 |
| | B5 | 0.074 | 0.024 | 0.030 | 0.010 | 0.010 | 0.109 | 5.4 | 23.1 | 0.009 | 0.0071 | 0.0161 | — | 0.016 | |
| | B6 | 0.095 | 0.027 | 0.041 | 0.012 | 0.015 | 0.021 | 5.5 | 28.3 | 0.012 | 0.0074 | 0.0194 | — | 0.020 | |
| | B7 | 0.087 | 0.029 | 0.036 | 0.008 | 0.014 | 0.020 | 6.9 | 20.1 | 0.010 | 0.0081 | 0.0181 | — | 0.019 | |
| | B8 | 0.092 | 0.031 | 0.043 | 0.009 | 0.009 | 0.020 | 5.3 | 22.5 | 0.003 | 0.0207 | 0.0237 | — | 0.019 | |
| | B9 | 0.071 | 0.023 | 0.040 | 0.004 | 0.004 | 0.024 | 4.9 | 19.3 | 0.007 | 0.0055 | 0.0125 | Ti: 0.33 | 0.016 | Ti: 0.077 |
| | B10 | 0.087 | 0.024 | 0.035 | 0.012 | 0.016 | 0.027 | 5.2 | 20.2 | 0.009 | 0.0083 | 0.0173 | Ti: 0.19 | 0.019 | Ti: 0.094 |
| | B11 | 0.091 | 0.027 | 0.033 | 0.015 | 0.016 | 0.026 | 5.2 | 20.1 | 0.011 | 0.0065 | 0.0175 | Ti: 0.24 | 0.019 | Ti: 0.096 |
| | | | | | | | | | | | | | Nb: 0.15 | | Nb: 0.19 |

TABLE 3

| | Steel | Hot-workability | Toughness of hot-rolled strip | Cold-workability |
|---|---|---|---|---|
| Present Invention | A1 | a | aa | a |
| | A2 | a | a | a |
| | A3 | a | a | a |
| | A4 | a | a | a |
| | A5 | a | a | a |
| | A6 | a | a | a |
| | A7 | a | aa | a |
| | A8 | a | aa | a |
| | A9 | a | aa | a |

TABLE 3-continued

| | Steel | Hot-workability | Toughness of hot-rolled strip | Cold-workability |
|---|---|---|---|---|
| | A10 | a | aa | a |
| | A11 | a | aa | a |
| Comparison | B1 | x | — | a |
| | B2 | x | — | a |
| | B3 | a | xx | a |
| | B4 | a | x | a |
| | B5 | a | xx | a |
| | B6 | a | xx | x |
| | B7 | a | xx | x |
| | B8 | a | x | a |
| | B9 | a | x | a |
| | B10 | a | x | a |
| | B11 | a | x | a |

TABLE 4

(wt %)

| Steel | | Lanthanoids total | La | Ce | Pr | Nd | P | Al | Cr | C | N | C + N | Others | lower limit of P | Upper limit of Ti and Nb | Abnormal oxidation life of foil (hr) | Elongation of foil by oxidation (%) |
|---|---|---|---|---|---|---|---|---|---|---|---|---|---|---|---|---|---|
| Present Invention | A1 | 0.087 | 0.031 | 0.043 | 0.004 | 0.009 | 0.024 | 5.3 | 19.3 | 0.007 | 0.0065 | 0.0135 | — | 0.019 | | 300 | 0.8 |
| | A2 | 0.089 | 0.034 | 0.041 | 0.006 | 0.008 | 0.037 | 5.1 | 20.3 | 0.007 | 0.0055 | 0.0125 | — | 0.019 | | 313 | 0.9 |
| | A3 | 0.095 | 0.032 | 0.040 | 0.010 | 0.013 | 0.042 | 5.2 | 20.1 | 0.006 | 0.0043 | 0.0103 | — | 0.020 | | 300 | 1.0 |
| | A4 | 0.108 | 0.033 | 0.051 | 0.011 | 0.013 | 0.026 | 5.1 | 20.8 | 0.008 | 0.0077 | 0.0157 | — | 0.022 | | 273 | 0.9 |
| | A5 | 0.109 | 0.031 | 0.045 | 0.016 | 0.017 | 0.036 | 5.1 | 19.7 | 0.010 | 0.0066 | 0.0166 | — | 0.023 | | 293 | 0.9 |
| | A6 | 0.143 | 0.041 | 0.062 | 0.020 | 0.023 | 0.041 | 5.4 | 20.7 | 0.011 | 0.0054 | 0.0164 | — | 0.028 | | 293 | 1.3 |
| | A7 | 0.075 | 0.028 | 0.036 | 0.003 | 0.008 | 0.026 | 5.6 | 19.2 | 0.006 | 0.0042 | 0.0102 | — | 0.016 | | 287 | 0.7 |
| | A8 | 0.085 | 0.031 | 0.037 | 0.006 | 0.011 | 0.021 | 6.3 | 16.3 | 0.011 | 0.0065 | 0.0175 | Nb: 0.17 | 0.018 | Nb: 0.19 | 347 | 1.1 |
| | A9 | 0.091 | 0.029 | 0.043 | 0.008 | 0.011 | 0.043 | 5.3 | 24.2 | 0.012 | 0.0096 | 0.0216 | Nb: 0.15 | 0.019 | Nb: 0.23 | 293 | 1.4 |
| | A10 | 0.073 | 0.025 | 0.039 | 0.003 | 0.006 | 0.028 | 5.2 | 19.1 | 0.009 | 0.0069 | 0.0159 | Ti: 0.063 | 0.016 | Ti: 0.089 | 263 | 0.7 |
| | A11 | 0.095 | 0.034 | 0.041 | 0.009 | 0.011 | 0.029 | 5.0 | 20.7 | 0.011 | 0.0077 | 0.0187 | Ti: 0.063<br>Nb: 0.14 | 0.020 | Ti: 0.100<br>Nb: 0.20 | 273 | 0.8 |
| | A12 | 0.107 | 0.032 | 0.050 | 0.012 | 0.013 | 0.041 | 5.0 | 21.0 | 0.009 | 0.0063 | 0.0153 | — | 0.022 | | 287 | 1.0 |
| | A13 | 0.068 | 0.022 | 0.030 | 0.008 | 0.008 | 0.019 | 5.2 | 20.1 | 0.011 | 0.0064 | 0.0174 | — | 0.015 | | 260 | 0.9 |
| | A14 | 0.077 | 0.028 | 0.035 | 0.005 | 0.009 | 0.037 | 5.3 | 18.7 | 0.008 | 0.0071 | 0.0151 | — | 0.017 | | 300 | 1.0 |
| | A15 | 0.073 | 0.026 | 0.035 | 0.004 | 0.008 | 0.044 | 5.2 | 19.7 | 0.008 | 0.0067 | 0.0147 | | 0.016 | | 313 | 0.8 |
| Present Invention | A16 | 0.078 | 0.026 | 0.035 | 0.007 | 0.010 | 0.036 | 5.1 | 19.3 | 0.009 | 0.0066 | 0.0156 | Ti: 0.052 | 0.017 | Ti: 0.088 | 273 | 0.7 |
| | A17 | 0.084 | 0.030 | 0.038 | 0.007 | 0.009 | 0.044 | 5.2 | 20.1 | 0.006 | 0.0055 | 0.0115 | Ti: 0.048 | 0.018 | Ti: 0.072 | 287 | 0.6 |
| | A18 | 0.067 | 0.024 | 0.033 | 0.004 | 0.006 | 0.042 | 5.2 | 19.8 | 0.009 | 0.0081 | 0.0171 | — | 0.015 | | 273 | 1.2 |
| | A19 | 0.124 | 0.036 | 0.052 | 0.015 | 0.020 | 0.028 | 5.2 | 20.3 | 0.010 | 0.0063 | 0.0163 | — | 0.025 | | 293 | 1.2 |
| Comparison | B12 | 0.025 | 0.008 | 0.010 | 0.003 | 0.004 | 0.011 | 5.4 | 20.3 | 0.010 | 0.0045 | 0.0145 | | (0.007) | | 120 | 2.7 |
| | B13 | 0.047 | 0.013 | 0.020 | 0.007 | 0.007 | 0.015 | 5.3 | 20.5 | 0.007 | 0.0067 | 0.0137 | | (0.012) | | 167 | 2.1 |
| | B14 | 0.167 | 0.047 | 0.074 | 0.020 | 0.026 | 0.034 | 5.1 | 19.9 | 0.008 | 0.0067 | 0.0147 | | 0.033 | | 193 | 3.1 |
| | B15 | 0.162 | 0.160 | tr. | tr. | 0.002 | 0.032 | 5.6 | 19.2 | 0.010 | 0.0054 | 0.0154 | | 0.032 | | 193 | 2.9 |

TABLE 5

| | Steel | Elongation of catalyst-carrier (%) | Visual observation of shape change, etc. |
|---|---|---|---|
| Present Invention | A4 | 1.4 | small shape change |
| | A9 | 1.9 | small increase of diameter at ends |
| | A10 | 1.6 | small shape change |
| Comparison | B12 | 7.3 | expansion at ends, large shape change |
| | B14 | 4.5 | increase of diameter at ends, large shape change |

What is claimed is:

1. A heat-resistant stainless steel foil for a catalyst-carrier of combustion exhaust gas purifiers, consisting essentially in weight percentage of:

more than 0.06 up to 0.15 of Ln, said Ln, being a mixture of La, Ce, Pr and Nd;

from 8x(%Ln+0.015)/45 to 0.1 of P;

from 4.5 to 6.5 of Al;

from 13 to 25 of Cr;

not more than 0.025 of C;

not more than 0.02 of N;

not more than 0.03 of C+N; and the balance consisting of Fe and unavoidable impurities.

2. A heat-resistant stainless steel foil according to claim 1, further containing (0.03+4x%C+24x%N/7) wt % or less of Ti.

3. A heat-resistant stainless steelfoil according to claim 1, further containing (93x%C/12+93x%N/14)x1.5 wt % or less of Nb.

4. A heat-resistant stainless steel foil according to claim 1, further containing (0.03+4x%C+24x%N/7) wt % or less of Ti and (93x%C/12+93x%N/14)x1.5 wt % or less of Nb.

5. A heat-resistant stainless steel foil according to claim 2, wherein the Ti content is 0.02 wt % or more.

6. A heat-resistant stainless steel foil according to claim 3, wherein the Nb content is (93x%C/12+93x%N/14)x0.8 wt % or more.

7. A heat-resistant stainless steel foil according to claim 4, wherein the Ti content is 0.02 wt % or more and the Nb content is (93x%C/12+93x%N/14)x0.8 wt % or more.

* * * * *

UNITED STATES PATENT AND TRADEMARK OFFICE

CERTIFICATE OF CORRECTION

PATENT NO. : 5,045,404

DATED : September 3, 1991

INVENTOR(S) : Keiichi OHMURA, et al.

It is certified that error appears in the above-identified patent and that said Letters Patent is hereby corrected as shown below:

Column 4, line 42, change "causes" to --cause--.

Column 4, line 43, before "the toughness" insert --of--.

Column 16, line 8, change "steelfoil" to --steel foil--.

FIG. 1, change "LABOLATORY" to --LABORATORY--.

Signed and Sealed this

Twenty-second Day of June, 1993

*Attest:*

Michael K. Kirk

MICHAEL K. KIRK

*Attesting Officer*

*Acting Commissioner of Patents and Trademarks*